US005144874A

United States Patent [19]

Garrett

[11] Patent Number: 5,144,874

[45] Date of Patent: Sep. 8, 1992

[54] ROTARY CUTTER KNIFE

[76] Inventor: Jimmy R. Garrett, Route 1, Box 569, Worden, Ill. 62097

[21] Appl. No.: 702,930

[22] Filed: May 20, 1991

[51] Int. Cl.[5] ..... B26D 1/15

[52] U.S. Cl. ..... 83/332; 83/345; 83/500; 83/673; 83/699

[58] Field of Search ..... 83/332, 699, 673, 676, 83/345, 500; 493/368, 471; 30/335

[56] References Cited

U.S. PATENT DOCUMENTS

| | | | |
|---|---|---|---|
| 1,235,293 | 7/1917 | Daven | 493/354 |
| 1,670,314 | 5/1928 | Pearsall | 83/332 |
| 1,670,317 | 5/1928 | Seymour | 83/332 |
| 2,181,197 | 11/1939 | Moritz | 83/673 |
| 3,211,066 | 10/1965 | Palamenti | 93/58.2 |
| 3,518,922 | 7/1970 | Kuehn | 93/58.2 |
| 3,772,953 | 11/1973 | Sullivan | 83/332 |
| 3,850,069 | 11/1974 | Saunders | 83/665 |
| 3,857,314 | 12/1974 | Gregoire | 83/699 X |
| 3,985,066 | 10/1976 | Kern | 93/58.2 |
| 4,167,884 | 9/1979 | Santanna | 83/671 |
| 4,254,680 | 3/1981 | Gauthier | 83/665 |
| 4,502,357 | 3/1985 | Hussissian | 83/332 |
| 4,643,060 | 2/1987 | Fremion | 83/332 X |
| 4,932,298 | 6/1990 | Capdebosco | 83/332 |
| 5,002,524 | 3/1991 | Mills | 83/332 X |

*Primary Examiner*—Douglas D. Watts
*Assistant Examiner*—Kenneth E. Peterson
*Attorney, Agent, or Firm*—Grace J. Fishel

[57] ABSTRACT

A rotary cutter knife for use in a slotting or slitting head. The cutter knife is an assembly of an arc-shaped holder with one or more cutting elements attached in a manner such that the elements are replaceable and circumferentially adjustable.

8 Claims, 2 Drawing Sheets

ROTARY CUTTER KNIFE

The present invention relates to a rotary cutter knife for a slotting or slitting head comprising an arc-shaped holder with one or more cutting elements attached in a manner such that the elements are replaceable and circumferentially adjustable.

BACKGROUND OF THE INVENTION

In the manufacture of cartons, a paperboard blank is fed between pairs of coacting upper and lower slotting heads which selectively cut slots in the blank. Each of the upper slotting heads is provided with one or more male slotter knives and each of the lower heads is provided with a pair of axially spaced, annular cutting discs. The annular cutting discs form a peripheral groove for receiving the cutting edges of the male slotter knife.

The length of the male slotter knife determines the length of the slot. Long slotter knives are very expensive and it is necessary for carton manufacturers to stock a large assortment of knife sizes.

The cutting edges of the male slotter knife eventually become chipped as the male slotter knife enters the peripheral groove in the lower slotting head. Also, metal-to-metal contact between the male slotter knife and the groove wears down the cutting edges on the male slotter knives, requiring that they be replaced more frequently than is desirable in order that the slot be cut cleanly. Replacement of the male slotter knives is a major repair and requires realignment of the upper and lower slotting heads.

To alleviate the above problems, the present invention provides a slotter knife with a holder capable of mounting one or more replaceable cutting elements for building up a longer knife of a needed size. The replaceable cutting elements provide for quick and easy sharpening of the slotter knife without requiring detachment of the holder from the slotting head and major realignment.

In a slitting head, the slitting knives are butted end-to-end for trimming the side edges of the blank. The knives for the slitting heads are generally similar to the knives for the slotting heads and so are the problems.

SUMMARY OF THE INVENTION

A rotary cutter knife in accordance with the present invention is characterized by an arc-shaped holder adapted for attachment to a rotary cutter. The arc-shaped holder has an outer rim to which one or more cutting elements are attached in a common arc. A fastening means is provided for attaching the cutting elements to the holder in a manner so that the cutting elements are replaceable and circumferentially adjustable.

An important object of the invention is to provide a knife for a rotary cutter which can be used to make up a large assortment of knife sizes and types for use on a slotting or slitting head.

Another object is to provide a cutter knife with portions which are replaceable for quick and easy sharpening of the knife.

Yet another object is to provide a cutter knife with cutting elements attached to a holder in a manner such that they are circumferentially adjustable without detaching the holder from the slotting or slitting head.

Other objects and features of the invention will be in part apparent and in part pointed out hereinafter. The invention accordingly comprises the constructions hereinafter described, the scope of the invention being indicated by the subjoined claims.

BRIEF DESCRIPTION OF THE DRAWINGS

In the accompanying drawings, in which several of various possible embodiments of the invention are illustrated, corresponding reference characters refer to corresponding parts throughout the several views of the drawings and in which.

DETAILED DESCRIPTION OF THE INVENTION

Figure 1:
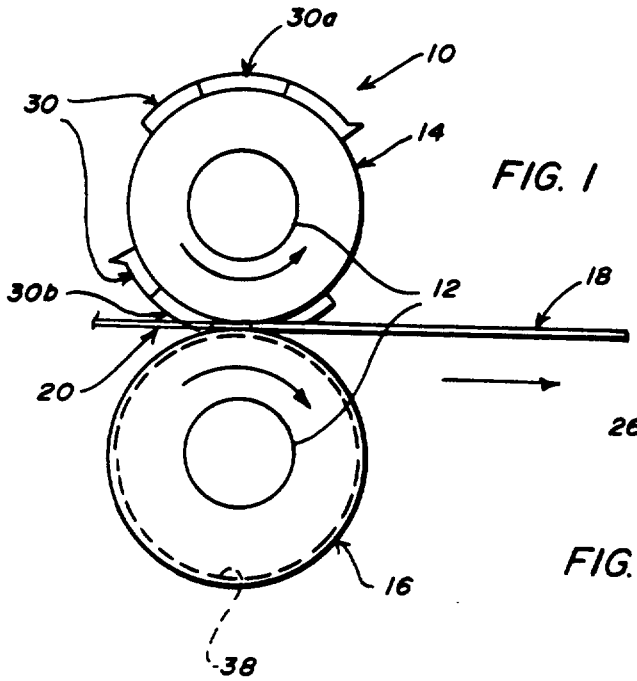
FIG. 1 is a schematic view of a rotary slotter.
Figure 2:
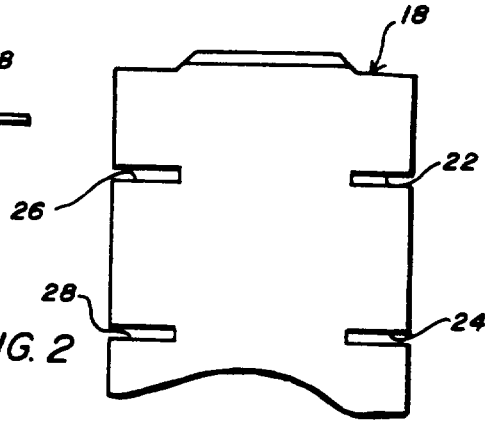
FIG. 2 is a plan view of a portion of a blank.

Referring to FIGS. 1 and 2, a rotary slotter 10 includes a pair of shafts 12 upon which are mounted a plurality of upper slotter heads 14 and a corresponding number of lower slotter heads 16. For purpose of illustration, a box blank 18 is produced by passing a sheet of corrugated board 20 through rotary slotter 10. Rotary slotter 10 cuts slots 22 and 24 and slots 26 and 28 in the leading and trailing edges of box blank 18, respectively, with provision optionally made for cutting intermediate slots.

Each upper slotter head 14 is provided with one or more slotter knives 30 (usually at least two 30*a* and 30*b*). Slotter knives 30 in accordance with the present invention are formed in main part from a holder 32, one or more cutting elements 34 and a fastening means 36 for attaching the cutting elements to the holder. Knives 30 project beyond the periphery of the slotter head and each knife is adapted to cooperate with an annular groove 38 in opposing lower slotter head 16.

Figure 3:
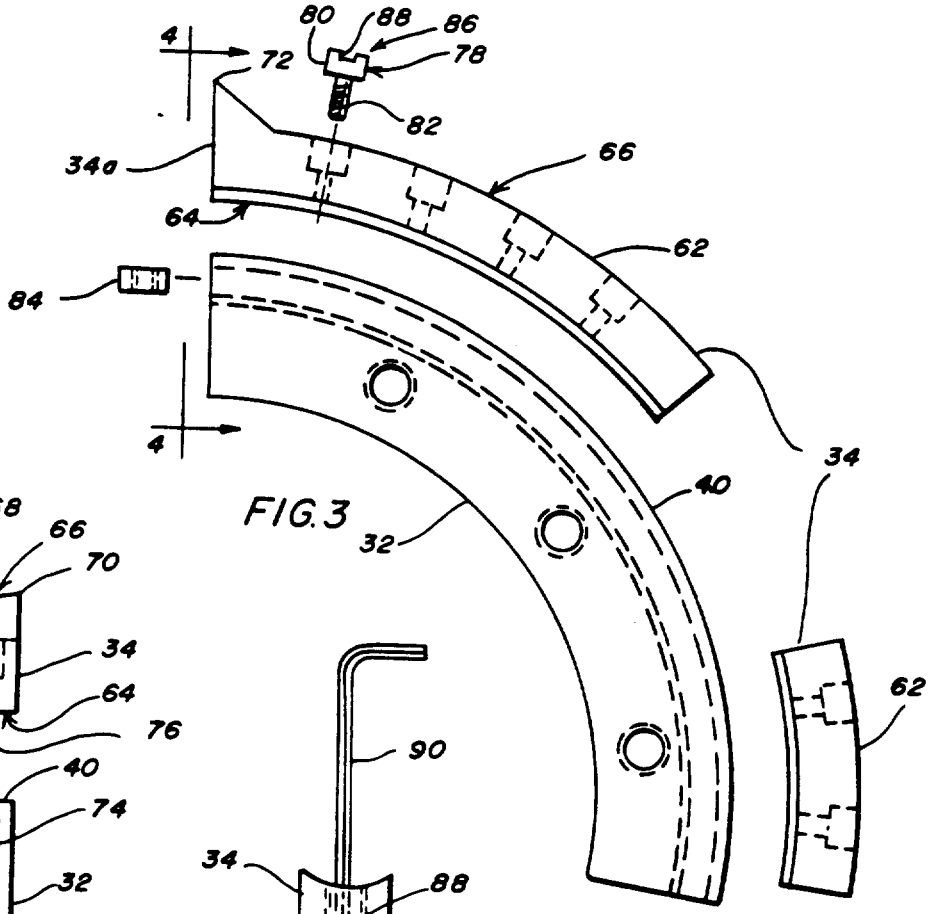
FIG. 3 is an exploded plan view of a rotary cutter knife in accordance with the present invention.
Figure 4:
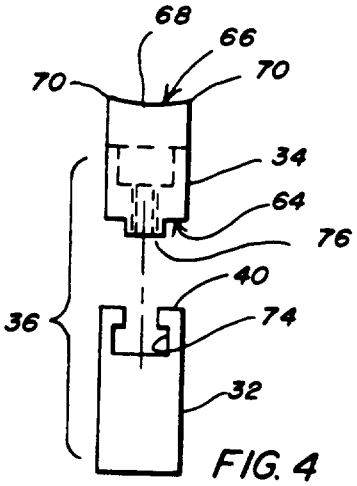
FIG. 4 is a view on an enlarged scale taken along line 4—4 in FIG. 3.

As best seen in FIGS. 3 and 4, holder 32 comprises a flat generally thin arc-shaped plate with an outer rim 40 to which cutting elements 34 are attached in a common arc. Holder 32 is adapted for attachment to upper slotter head 14 preferably in a manner such that knives 30 are circumferentially adjustable. Two of various possible ways in which holder 32 may be adapted for attaching knives 30 are illustrated in FIGS. 5 and 6.

Figure 5:
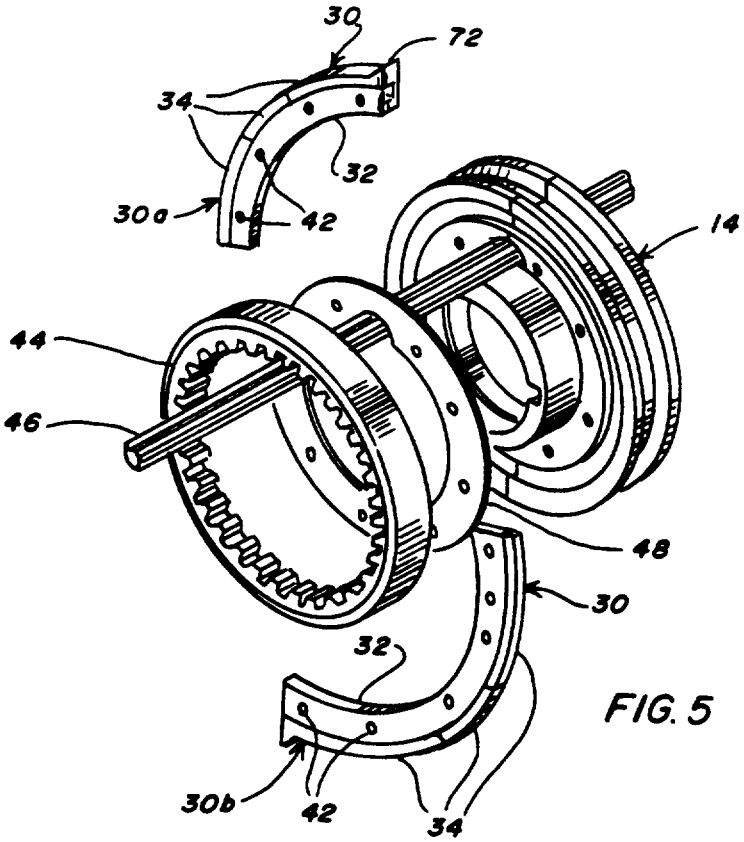
FIG. 5 is a perspective exploded view of a pair of rotary cutter knives in accordance with the present invention illustrating one manner in which the holder can be adapted for attachment to the upper slotter head of the rotary slotter; and, FIG. 6 is a perspective exploded view of a rotary cutter knife in accordance with the present invention illustrating another manner in which the holder can be adapted for attachment to the upper slotter head.

As illustrated in FIG. 5, apertures 42 are provided in holder 32 for bolting knives 30*a* to upper slotter head 14 and knives 30*b* to a toothed ring 44 mounted on a splined shaft 46. A spacer disk 48 separates slotter head 14 and toothed ring 44. Splined shaft 46 can be used to rotate toothed ring 44 to circumferentially adjust knives 30*b* with respect to knives 30*a*.

Figure 6:
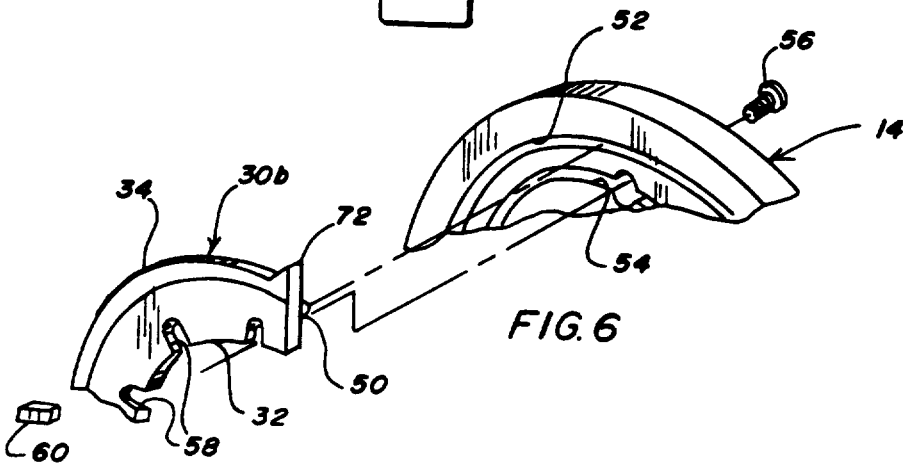

With reference to FIG. 6, holder 32 of knives 30*b* includes an arcuate protrusion 50 extending from one side which is received in a complementary shaped recess 52 formed in slotter head 14. A second and concentric recess 54 of T-cross section is provided in slotter head 14 for receipt of a bolt 56, the head of which is slidably located in the base of concentric recess 54. The shank of bolt 56 passes through an aperture 58 in holder 32 to receive a nut 60. Knives 30*a* (not shown) are fixedly bolted to slotter head 14 in known manner. When nut 60 is loose, knives 30*b* can be moved around concentric recess 54 and circumferentially adjusted with respect to knives 30*a*.

Cutting elements 34 comprise a generally narrow arc-shaped band 62 with an inner rim 64 which fits flush against outer rim 40 of holder 32 such that cutting elements 34 are in a common arc with holder 32 and with each other. Cutting elements 34, like holder 32 are generally thin, preferably identical in thickness to holder 32. As best seen in FIG. 4, outer rim 66 of cutting elements 34 may be slightly concave at 68 between cutting edges 70. Cutting elements 34 may also include a conventional spur 72 at one end. That portion of cutting element 34 with spur 72 can be an integral part of a larger cutting element or as shown in FIG. 3 provided as a separate tip segment 34*a*.

Fastening means 36 attach cutting elements 34 to holder 32 in a manner so that the cutting elements are replaceable and circumferentially adjustable. In the embodiment illustrated, cutting elements 34 are inserted into holder 32. Fastening means 36 comprise a mortise 74 with a T-cross section running the length of outer rim 40 of holder 32 for cooperative fit with a tenon 76 running the length of inner rim 64 of arc-shaped band 62. A bolt 78 completes fastening means 36 passing through band 62 from outer to inner rims 66, 64 (respectively). Bolt 78 has a head 80, a threaded shank 82 and a nut 84 which is threadedly received on the shank. Either head 80 or nut 84 is slidably received and stopped from rotation in the base of T-shaped mortise 74.

Figure 4A:
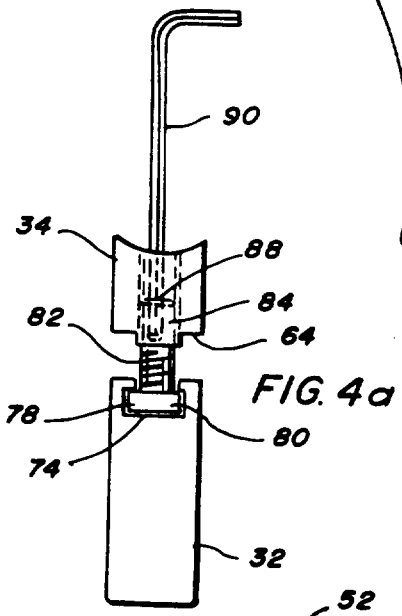
FIG. 4*a* is similar to FIG. 4 but with certain parts reversed.

With continuing reference to the embodiment illustrated in FIGS. 3 and 4, nut 84 is rectangular in shape and is received in mortise 74 with its longer side parallel to the side edges of the mortise. Head 80 includes a suitable means for turning head 86 such as a hex slot 88 and is countersunk in outer rim 66. The parts can be reversed as shown in FIG. 4*a*, with head 80 shaped for receipt in T-shaped mortise 74, in which case nut 84 is threaded into a tapped hole provided in outer rim 66 and provided with means (such as hex slot 88) for turning it with a hex Allenwrench 90 or the like.

In use, one or more cutting elements 34 are attached to holder 32 to form knives 30 of a selected length. For this purpose, each band 62 is readied for attachment by inserting bolts 78 and threading nuts 84 on loosely. Starting at one end of holder 32, nuts 84 are slid into mortise 74 and cutting elements 34 circumferentially adjusted along holder 32 to the selected position. Cutting elements 34 are then locked in place by tightening heads 80.

It is advantageous to provide an inventory of cutting elements 34 of various lengths, with and without spurs 72 and so forth as this permits the user to make up a large assortment of knife sizes and types. For example, if cutting elements 34 are spaced apart as shown in FIG. 3, the unfilled area of holder 32 between cutting elements 34 will form a skip. On the other hand, when cutting elements are butted end-to-end, their cutting edges 70 are aligned in a continuous arc of substantially uniform radius formed about a common center, so that the assembly functions in the same manner as a single relatively longer slotter knife.

Holder 32 with cutting elements 34 attached is then mounted to rotary slotter 10 (or to a slitter) in the manner of an ordinary slotter knife. In some instances, it is possible to replace cutting elements 34 without removing holder 32 from slotter head 14. This very advantageous as it permits quick and easy sharpening of the slotter knife without disturbing the alignment between the upper and lower slotting heads. In addition, circumferential adjustability of cutting elements 34 on holder 32 allows the operator to finely adjust the cut of the knife without detaching the holder from the cutter head.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed is:

1. A rotary cutter knife for a slotting or slitting head, said cutter knife comprising an arc-shaped holder adapted for attachment to the slotting or slitting head, one or more narrow, band-like cutting elements having outer cutting edges and inner arcuate edges, said arc-shaped holder having an outer arcuate rim to which said inner arcuate edges of the one or more cutting elements are attached in a common arc, and a fastening means extending from the inner arcuate edges of said one or more cutting elements for attaching the cutting elements to the outer arcuate rim of the older so that the one or more cutting elements are replaceable and circumferentially adjustable.

2. The rotary cutter knife of claim 1 wherein the holder is a flat generally thin arc-shaped plate an each of the one or more cutting elements is a generally narrow arc-shaped band with its inner arcuate edge flush against the outer rim of the holder.

3. The rotary cutter knife of claim 2 wherein the fastening means comprises a mortise with a base and a T-cross section running along the outer rim of the holder for cooperative fit with a tenon running the length of the inner rim of the band and a bolt.

4. The rotary cutter knife of claim 3 wherein the band has an outer rim and the bolt has a head, a threaded shank and a nut which is threadedly received on the shank, said bolt passing through the band from the outer rim to the inner rim and said head or nut slidable received and stopped from rotation in the base of the mortise with the T-cross section.

5. A rotary cutter knife for a slotting or slitting head, said cutter knife comprising an arc-shaped holder adapted for attachment to the slotting or slitting head, said holder being a flat generally thin arc-shaped plate with an outer rim;

one or more cutting elements, each of which is a generally narrow arc-shaped band with an inner rim and an outer rim;

said inner rim of the arc-shaped band fitting flush against the outer rim of the arc-shaped plate to which it is attached in a common arc;

and a fastening means extending from the inner rim of the one or more cutting elements for attaching the one or more cutting elements to the holder so that the one or more cutting elements are replaceable and circumferentially adjustable, said fastening means comprising a mortise with a base and a T-cross section running along the outer rim of the holder for cooperative fit with a tenon running the length of the inner rim of the band and a bolt with a head, a threaded shank and a nut which is threadedly received on the shank, said bolt passing through the band from the outer rim to the inner rim and said head or nut slidably received and stopped from rotation in the base of the mortise having the T-cross section.

6. The rotary cutter of claim 5 wherein the nut of the bolt of the fastening means is received in the base of the mortise having the T-cross section and wherein the head is countersunk in the outer rim of the arc-shaped band.

7. The rotary cutter knife of claim 6 wherein at least two cutting elements are attached to the holder in spaced apart condition whereby the rotary cutter knife can be used to cut a skip between two slots.

8. The rotary cutter knife of claim 6 wherein at least two cutting elements are attached to the holder in end-to-end condition whereby the rotary cutter knife functions in the same manner as a single relatively longer cutter knife.

* * * * *

UNITED STATES PATENT AND TRADEMARK OFFICE

CERTIFICATE OF CORRECTION

PATENT NO. : 5,144,874

DATED : September 8, 1992

INVENTOR(S) : Jimmy R. Garrett

It is certified that error appears in the above-identified patent and that said Letters Patent is hereby corrected as shown below:

Column 4, line 38, "older" should read --holder--.

Signed and Sealed this

Seventh Day of September, 1993

Bruce Lehman

*Attest:*

BRUCE LEHMAN

*Attesting Officer*

*Commissioner of Patents and Trademarks*